US009134678B2

(12) United States Patent
Yamada

(10) Patent No.: US 9,134,678 B2
(45) Date of Patent: Sep. 15, 2015

(54) DISPLAY PORTION AND IMAGE FORMING APPARATUS COMPRISING THE SAME

(71) Applicant: KYOCERA Document Solutions Inc., Osaka (JP)

(72) Inventor: Yohei Yamada, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 14/521,185

(22) Filed: Oct. 22, 2014

(65) Prior Publication Data

US 2015/0117890 A1 Apr. 30, 2015

(30) Foreign Application Priority Data

Oct. 29, 2013 (JP) ..... 2013-224310

(51) Int. Cl.
*G03G 15/00* (2006.01)

(52) U.S. Cl.
CPC ..... *G03G 15/6552* (2013.01); *G03G 15/502* (2013.01); *G03G 15/5016* (2013.01)

(58) Field of Classification Search
CPC ..... G03G 15/5016; G03G 15/502
See application file for complete search history.

(56) References Cited

U.S. PATENT DOCUMENTS

| | | | | |
|---|---|---|---|---|
| 7,539,433 | B2 * | 5/2009 | Hoshino et al. | 399/81 |
| 8,050,586 | B2 * | 11/2011 | Hoshino et al. | 399/81 |
| 8,849,144 | B2 * | 9/2014 | Hoshino et al. | 399/81 |
| 2007/0212097 | A1 * | 9/2007 | Hoshino et al. | 399/81 |
| 2007/0212098 | A1 * | 9/2007 | Hoshino et al. | 399/81 |
| 2007/0212100 | A1 * | 9/2007 | Kimoto et al. | 399/81 |
| 2012/0008976 | A1 * | 1/2012 | Hoshino et al. | 399/81 |

FOREIGN PATENT DOCUMENTS

JP 2012-126480 A 7/2012

* cited by examiner

*Primary Examiner* — Rodney Bonnette
(74) *Attorney, Agent, or Firm* — Stein IP, LLC

(57) ABSTRACT

An image forming apparatus includes an ejection tray, a printing portion and a display position. The printing portion prints, on a sheet, an image based on image data and ejects the printed sheet to the ejection tray. The display portion displays ejected-sheet information for notifying the orientation of the front and back surfaces of the printed sheet ejected to the ejection tray and the orientation of the printed image on the printed sheet.

10 Claims, 9 Drawing Sheets

DISPLAY PORTION AND IMAGE FORMING APPARATUS COMPRISING THE SAME

INCORPORATION BY REFERENCE

This application is based upon and claims the benefit of priority from the corresponding Japanese Patent Application No. 2013-224310 filed on Oct. 29, 2013, the entire contents of which are incorporated herein by reference.

BACKGROUND OF THE INVENTION

The present disclosure relates to an image forming apparatus that includes an ejection tray to which a printed sheet is ejected.

An image forming apparatus such as a multifunctional machine includes a printing portion that transports a sheet along a sheet transport path, that prints an image based on image data onto the sheet being transported and that thereafter ejects the printed sheet. In such an image forming apparatus, an ejection tray is generally provided that receives the printed sheet when the printed sheet is ejected.

In a conventional image forming apparatus, the orientation of the front and back surfaces of a printed sheet that is ejected to an ejection tray can be arbitrarily set. Specifically, in a state (face-down state) where the front surface of the front and back surfaces of the printed sheet is faced downward, the printed sheet can be ejected to the ejection tray whereas in a state (face-up state) where the front surface is faced upward, the printed sheet can also be ejected to the ejection tray.

The orientation of a printed image on the printed sheet that is ejected to the ejection tray differs depending on, for example, the type of image forming apparatus. Specifically, there is an image forming apparatus in which a printed sheet is ejected such that the orientation of a printed image on the printed sheet is faced leftward when seen from the front surface side of the apparatus, and there is also an image forming apparatus in which a printed sheet is ejected such that the orientation of a printed image on the printed sheet is faced rightward when seen from the front surface side of the apparatus. There is also an image forming apparatus in which the orientation of a printed image on a printed sheet that is ejected to an ejection tray can be arbitrarily set.

For example, in a case where the front surface of a printed sheet that is ejected to an ejection tray is faced downward, and where the orientation of a printed image on the printed sheet is faced leftward when seen from the front surface side of the apparatus, when a user who faces the front surface of the apparatus takes, from the ejection tray, the printed sheet using the right hand with its back faced upward, the user can visually recognize the printed image on the front surface of the printed sheet in the correct orientation without changing the position of the printed sheet in the hand (in other words, when the user brings the printed sheet in front of the user, the front surface of the printed sheet faces the user, and the orientation of the printed image on the printed sheet is the correct orientation for the user). In another example, in a case where the front surface of a printed sheet that is ejected to an ejection tray is faced upward, and where the orientation of a printed image on the printed sheet is faced leftward when seen from the front surface side of the apparatus, when a user who faces the front surface of the apparatus takes, from the ejection tray, the printed sheet using the left hand with its palm faced upward, the user can visually recognize the printed image on the front surface of the printed sheet in the correct orientation without changing the position of the printed sheet in the hand.

However, in order to visually recognize the printed image on the front surface of the printed sheet in the correct orientation without changing the position of the printed sheet taken from the ejection tray, it is necessary to remember the specification (the orientation of the printed sheet ejected to the ejection tray) of the image forming apparatus. Hence, it is bothersome and inconvenient for the user.

SUMMARY OF THE INVENTION

An image forming apparatus of the present disclosure includes an ejection tray, a printing portion and a display position. The printing portion prints, on a sheet, an image based on image data and ejects the printed sheet to the ejection tray. The display portion displays ejected-sheet information for notifying the orientation of the front and back surfaces of the printed sheet ejected to the ejection tray and the orientation of the printed image on the printed sheet.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

An embodiment of the present disclosure will be described using, as an example, a multifunctional machine that has a plurality of functions such as a printing function, a copying function and a transmission function (for example, a fax function). In such a multifunctional machine, a plurality of types of jobs such as a printing job, a copying job and a transmission job (for example, a fax job) can be performed.

(Overall Configuration of the Multifunctional Machine)

Figure 1:
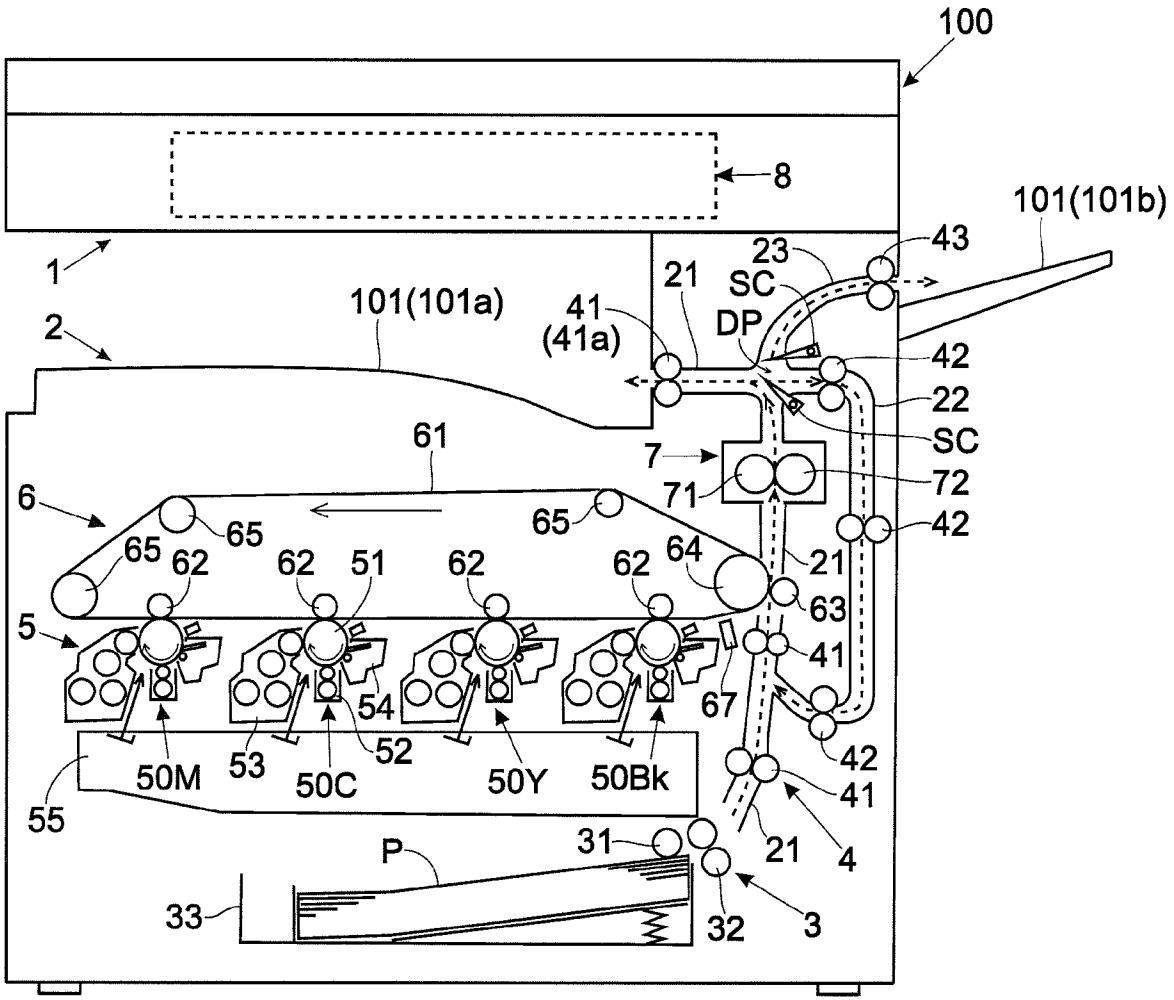
FIG. 1 A schematic diagram of a multifunctional machine according to an embodiment of the present disclosure.

As shown in FIG. 1, the multifunctional machine 100 includes an image reading portion 1 and a printing portion 2. The image reading portion 1 reads an original document to produce image data. The printing portion 2 transports a sheet P through a transfer nip and a fixing nip in this order, and prints, on the sheet P, an image based on image data (for example, the image data obtained by the reading of the original document by the image reading portion 1). Then, the printing portion 2 ejects the printed sheet P to an ejection tray 101. The multifunctional machine 100 has, as the ejection tray 101, an ejection tray 101*a* arranged within its main body, and an ejection tray 101*b* arranged on the side surface (the right side surface when seen from the front surface side of the apparatus) of the apparatus main body. The sheet P is ejected to the ejection tray 101*a* in the leftward direction when seen from the front surface side of the apparatus, and the sheet P is ejected to the ejection tray 101*b* in the rightward direction when seen from the front surface side of the apparatus.

The printing portion 2 is formed with a paper feed portion 3, a sheet transport portion 4, an image formation portion 5, a transfer portion 6 and a fixing portion 7. The printing portion 2 has, as a sheet transport path, a first transport path 21, a second transport path 22 and a third transport path 23. The first transport path 21 is a main transport path, extends through the transfer nip and the fixing nip in this order and reaches the ejection tray 101*a*. The second transport path 22 is a transport path for reversing the front and back surfaces of the sheet P at the time of double-sided printing, branches from the first transport path 21 on the downstream side of the fixing nip in the sheet transport direction and is connected to the first transport path 21 on the upstream side of the transfer nip in the sheet transport direction. The third transport path 23 is a transport path for ejecting the sheet P to the ejection tray 101*b*, branches from the first transport path 21 on the downstream side of the fixing nip in the sheet transport direction and reaches the ejection tray 101*b*.

The paper feed portion 3 includes a pickup roller 31 and a paper feed roller pair 32. The paper feed portion 3 draws the sheet P from a sheet cassette 33, and feeds the sheet P to the first transport path 21.

The sheet transport portion 4 includes a switching claw SC arranged at a branch point DP (position on the downstream side of the fixing nip in the sheet transport direction) of the sheet transport path. The sheet transport portion 4 also includes transport roller pairs 41 arranged in the first transport path 21, transport roller pairs 42 arranged in the second transport path 22 and a transport roller pair 43 arranged in the third transport path 23.

The switching claw SC switches the transport path of the sheet P on the downstream side of the fixing nip in the sheet transport direction. In other words, the switching claw SC guides the sheet P fed out from the fixing nip to any one of the first transport path 21, the second transport path 22 and the third transport path 23. The transport roller pair 41 transports the sheet P along the first transport path 21, the transport roller pair 42 transports the sheet P along the second transport path 22 and the transport roller pair 43 transports the sheet P along the third transport path 23. Among the transport roller pairs 41, the transport roller pair 41 (41*a*) located on the side of the ejection tray 101*a* can be rotated reversely, and is rotated reversely with predetermined timing at the time of double-sided printing.

The image formation portion 5 includes photosensitive drums 51, charging devices 52, development devices 53, drum cleaning devices 54 and an exposure device 55. The image formation portion 5 forms toner images of the individual colors of black (Bk), yellow (Y), cyan (C) and magenta (M), and primarily transfers the toner images of the individual colors to an intermediate transfer belt 61, which will be described later. The image formation portion 5 is classified into mechanical portions 50Bk, 50Y, 50C and 50M corresponding to the individual colors. Each of these mechanical portions 50Bk, 50Y, 50C and 50M includes one photosensitive drum 51, one charging device 52, one development device 53 and one drum cleaning device 54; they are arranged such that the circumferential surface of the photosensitive drum 51 makes contact with the outside of the intermediate transfer belt 61, which will be described later.

The transfer portion 6 includes the intermediate transfer belt 61, primary transfer rollers 62 and a secondary transfer roller 63. The intermediate transfer belt 61 is put under tension over a drive roller 64 and a driven roller 65. The primary transfer rollers 62 are arranged on the inner side of the intermediate transfer belt 61, and the intermediate transfer belt 61 is sandwiched between the primary transfer rollers 62 and the photosensitive drums 51. The secondary transfer roller 63 is arranged through the intermediate transfer belt 61 to face the drive roller 64, and forms the transfer nip between the secondary transfer roller 63 and the intermediate transfer belt 61. The transfer portion 6 secondarily transfers the toner image transferred to the intermediate transfer belt 61 onto the sheet P that enters the transfer nip.

The fixing portion 7 includes a heating roller 71 and a pressure roller 72. The heating roller 71 incorporates a heating source. The pressure roller 72 is pressed onto the heating roller 71 to form the fixing nip between the pressure roller 72 and the heating roller 71. In this way, when the sheet P to which the toner image has been transferred enters the fixing nip, the sheet P is heated and pressurized, with the result that the toner image is fixed to the sheet P.

Here, in single-sided printing, the sheet P is passed through the transfer nip (the fixing nip) once, and thus the printing is completed. On the other hand, in double-sided printing, the sheet P is passed through the transfer nip (the fixing nip) twice, and thus the printing is completed.

In double-sided printing, the switching claw SC first guises, to the first transport path 21, the sheet P with one side printed that is fed from the fixing nip. First, the transport roller pair 41*a* is positively rotated. Thereafter, when the sheet P is completely passed through the branch point DP, the transport roller pair 41*a* is reversely rotated before the sheet P is completely passed through the nip of the transport roller pair 41*a*. In other words, the sheet P with one side printed is reversely fed. Then, the switching claw SC is turned so as to switch the transport path of the sheet P, and thereby guides the reversely fed sheet P to the second transport path 22. The sheet P fed to the second transport path 22 is transported by the transport roller pair 42 along the second transport path 22, and reaches the downstream side of the transfer nip in the sheet transport direction (which is fed to the first transport path 21 again). Here, the front and back surfaces of the sheet P are reversed. In this way, when the sheet P fed to the first transport path 21 again is passed through the transfer nip (the fixing nip), an image is printed on the surface of the sheet P that has not been printed. Thus, the double-sided printing is completed.

The printed sheet P (the sheet P with one side printed or the sheet P with both sides printed) is ejected to the ejection tray 101*a* or 101*b*. When the printed sheet P is ejected to the ejection tray 101*a*, the switching claw SC is turned in such a direction as to open the entrance port of the first transport path 21. In this way, the printed sheet P fed from the fixing nip is transported by the transport roller pair 41 (41*a*) along the first transport path 21 and is ejected to the ejection tray 101*a*. On the other hand, when the printed sheet P is ejected to the ejection tray 101*b*, the switching claw SC is turned in such a direction as to open the entrance port of the third transport path 23. In this way, the printed sheet P fed from the fixing nip is transported by the transport roller pair 43 along the third transport path 23 and is ejected to the ejection tray 101*b*.

Figure 2:
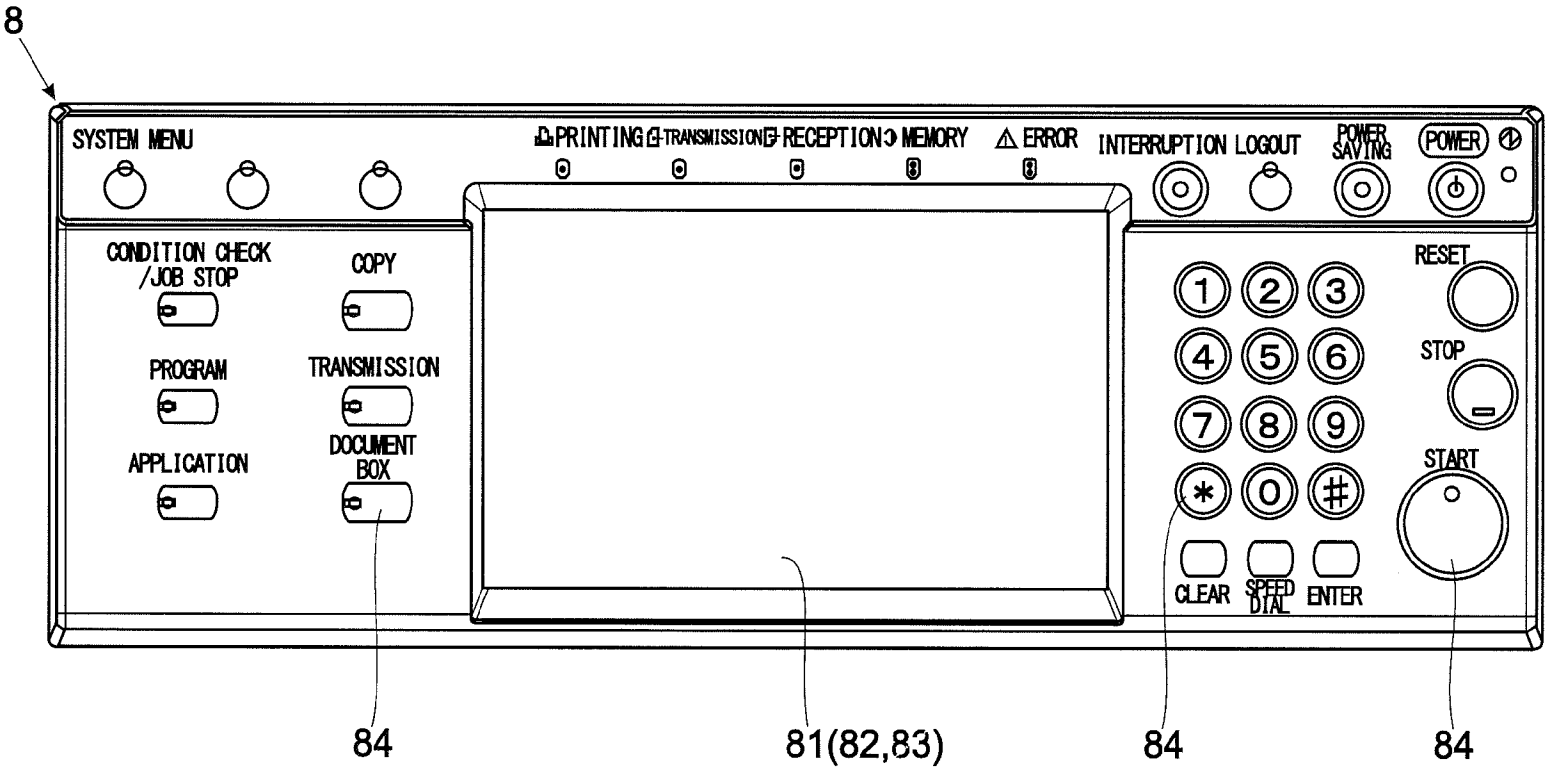
FIG. 2 A plan view of an operation panel fitted to the multifunctional machine according to the embodiment of the present disclosure.

The multifunctional machine 100 includes an operation panel 8 as shown in FIG. 2. The operation panel 8 is arranged on the front surface side (for example, an area indicated by broken lines of FIG. 1) of the multifunctional machine 100. In the operation panel 8, an operation display portion 81 is provided. The operation display portion 81 includes a liquid crystal display panel 82 and a touch panel 83 that is arranged on the display surface of the liquid crystal display panel 82. The operation display portion 81 displays, on the liquid crystal display panel 82, soft keys, messages and the like for receiving various types of settings, and receives various types of settings through the touch panel 83. In the operation panel 8, various types of hard keys 84 such as a start key, a stop key, a reset key and a numeric keypad are also provided.

(Hardware Configuration of the Multifunctional Machine)

Figure 3:
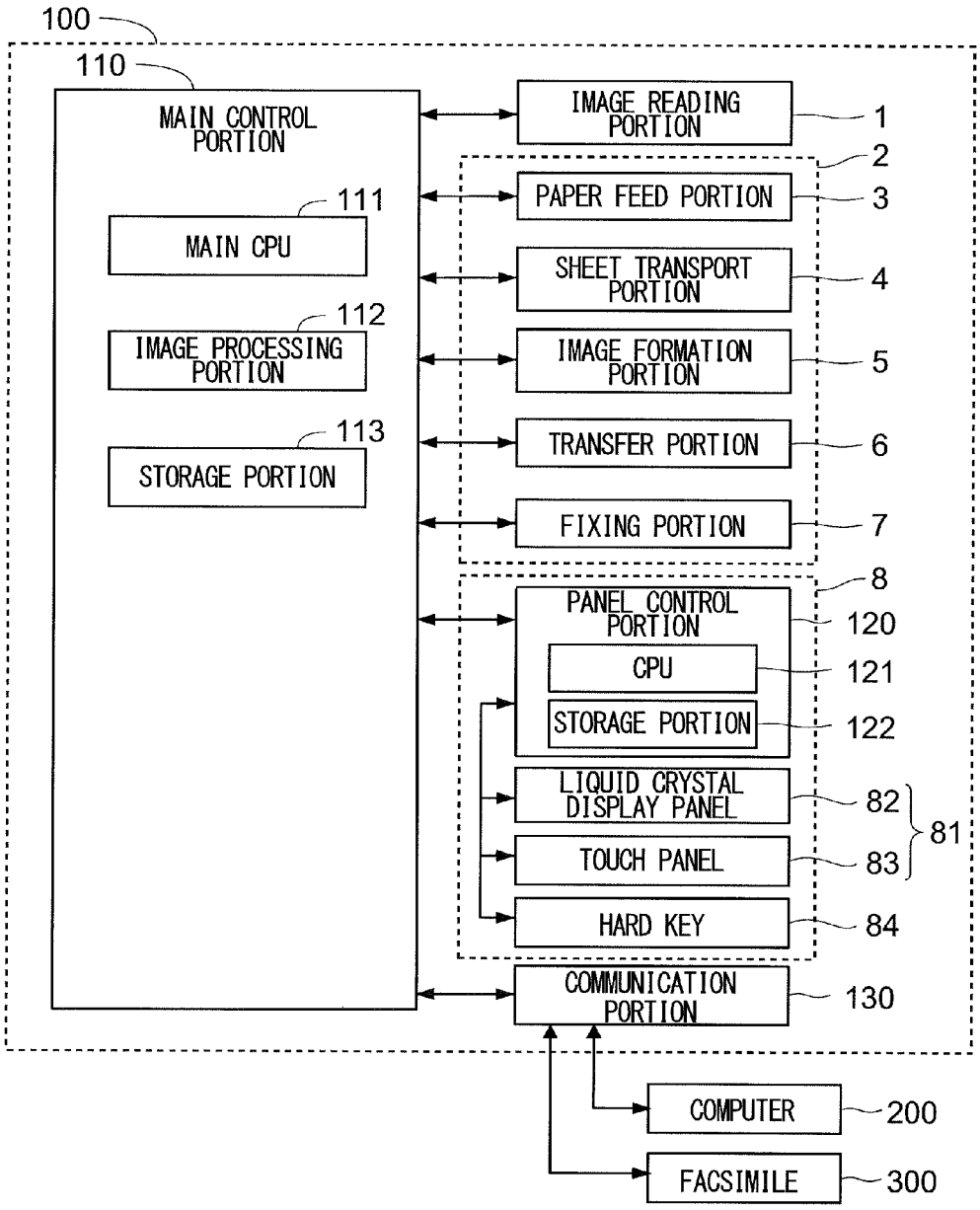
FIG. 3 A block diagram illustrating the hardware configuration of the multifunctional machine according to the embodiment of the present disclosure.

As shown in FIG. 3, the multifunctional machine 100 includes a main control portion 110. The main control portion 110 includes a main CPU 111, an image processing portion 112 and a storage portion 113. The image processing portion 112 is formed with an ASIC dedicated to image processing and the like, and performs image processing (such as enlargement/reduction, density conversion and data format conversion) on image data. The storage portion 113 is formed with a ROM, a RAM and the like, and stores control programs and data. The main control portion 110 controls the operations of the individual portions of the multifunctional machine 100 based on the programs and the data stored in the storage portion 113.

Specifically, the main control portion 110 is connected to the image reading portion 1 and the printing portion 2 (the paper feed portion 3, the sheet transport portion 4, the image formation portion 5, the transfer portion 6 and the fixing portion 7). The main control portion 110 controls the reading operation of the image reading portion 1 and the printing operation of the printing portion 2.

The main control portion 110 is also connected to a panel control portion 120. The panel control portion 120 includes a CPU 121 and a storage portion 122, and receives an instruction from the main control portion 110 to control the display operation of the operation panel 8 and to detect an operation performed on the operation panel 8. For example, the panel control portion 120 displays the soft keys on the liquid crystal display panel 82, and detects, when a touch operation is performed on a soft key, the soft key that receives the touch operation based on an output of the touch panel 83. The panel control portion 120 also detects, when a press-down operation of pressing down a hard key 84 is performed, the hard key 84 that receives the press-down operation based on an output of a switch in which the turning on and off thereof is switched by the pressing down of the hard key 84. Then, the panel control portion 120 detects the operation performed on the operation panel 8, and transmits the result of the detection to the main control portion 110. In this way, the main control portion 110 recognizes the operation performed on the operation panel 8.

The main control portion 110 is also connected to a communication portion 130. The communication portion 130 is connected such that communication can be performed through an external computer 200 (such as a user terminal or a server) and a network. In this way, it is possible to perform printing based on image data transmitted from the computer 200 and to transmit, to the computer 200, the image data obtained by the reading of the original document by the image reading portion 1. The communication portion 130 may incorporate a modem or the like. In this case, it is possible to perform fax communication with an external facsimile 300 through a network such as a telephone line.

(Orientation of the Printed Sheet Ejected to the Ejection Tray)

The operation panel 8 receives a mode setting as to whether the printed sheet P is ejected, in a sheet ejection mode that is either a face-down mode or a face-up mode. The face-down mode is a mode in which the front surface of the front and back surfaces of the printed sheet P is faced downward and the printed sheet P is ejected; the face-up mode is a mode in which the front surface of the front and back surfaces of the printed sheet P is faced upward and the printed sheet P is ejected. For example, in general, the face-down mode is set at a default mode.

Here, in single-sided printing, the printed sheet P (sheet P with one side printed) that has been passed through the fixing nip is transported, without being processed, along the first transport path 21, and is ejected to the ejection tray 101*a*, and thus the front surface of the printed sheet P is faced downward (face-down). On the other hand, the printed sheet P (sheet P with both sides printed) that has been passed through the fixing nip is transported along the third transport path 23, and is ejected to the ejection tray 101*b*, and thus the front surface of the printed sheet P is faced upward (face-up).

In double-sided printing, first, an image to be printed on the back surface is vertically reversed and is printed on the sheet P that is transported along the first transport path 21. Thereafter, the front and back surfaces of the sheet P with one side printed are reversed, and the sheet P is transported again along the first transport path 21. Then, an image to be printed on the front surface is printed, without being vertically reversed, on the sheet P with one side printed. Hence, when the printed sheet P (sheet P with both sides printed) is passed through the fixing nip, the orientation of the front and back surfaces of the printed sheet P and the orientation of the image printed on the printed sheet P (hereinafter simply referred to as the printed image on the printed sheet P) are the same as in single-sided printing. In other words, even in double-sided printing, the printed sheet P (sheet P with both sides printed) that has been passed through the fixing nip is transported, without being processed, along the first transport path 21, and is ejected to the ejection tray 101*a*, with the result that face-down is achieved whereas the printed sheet P (sheet P with both sides printed) that has been passed through the fixing nip is transported along the third transport path 23, and is ejected to the ejection tray 101*b*, with the result that face-up is achieved.

Hence, when the face-down mode is set, the turning position of the switching claw SC is controlled such that the printed sheet P which has been passed through the fixing nip is transported, without being processed, along the first transport path P. On the other hand, when the face-up mode is set, the turning position of the switching claw SC is controlled such that the printed sheet P which has been passed through the fixing nip is guided from the first transport path 21 to the third transport path 23. In this way, in the face-down mode, the printed sheet P is ejected to the ejection tray 101*a*, and the front surface of the printed sheet P is faced downward. On the other hand, in the face-up mode, the printed sheet P is ejected to the ejection tray 101*b*, and the front surface of the printed sheet P is faced upward.

In the face-down mode where the printed sheet P is ejected to the ejection tray 101*a*, whether single-sided printing or double-sided printing is performed, the orientation of the printed image on the printed sheet P is faced leftward when seen from the front surface side of the apparatus. In other words, the orientation of the printed image on the printed sheet P ejected to the ejection tray 101*a* is faced leftward when seen from the user who faces the front surface of the apparatus. On the other hand, in the face-up mode where the printed sheet P is ejected to the ejection tray 101*b*, whether single-sided printing or double-sided printing is performed, the orientation of the printed image on the printed sheet P ejected to the ejection tray 101*b* is faced rightward when seen from the front surface side of the apparatus (is faced rightward when seen from the user who faces the front surface of the apparatus).

However, the orientation of the printed image on the printed sheet P ejected to the ejection tray 101*a* and the orientation of the printed image on the printed sheet P ejected to the ejection tray 101*b* can also be arbitrarily set. For example, in single-sided printing, an image to be printed is vertically reversed, and thus the orientation of the printed image on the printed sheet P ejected to the ejection tray 101*a* can be faced rightward when seen from the front surface side of the apparatus, and the orientation of the printed image on the printed sheet P ejected to the ejection tray 101*b* can be faced leftward when seen from the front surface side of the apparatus. There is also a case where the orientation of the printed image on the printed sheet P ejected to the ejection tray 101*a* is fixedly faced leftward (or rightward) when seen from the front surface side of the apparatus, and the orientation of the printed image on the printed sheet P ejected to the ejection tray 101*b* is fixedly faced rightward (or leftward) when seen from the front surface side of the apparatus.

(Display of Ejected-Sheet Information and how-to-Take-the-Sheet Information>

When the printed sheet P is ejected to the ejection tray 101*a* (when the sheet ejection mode is the face-down mode), the front surface of the front and back surfaces of the printed sheet P is faced downward, and the orientation of the printed image on the printed sheet P is faced leftward when seen from the front surface side of the apparatus. In this case, when the user who faces the front surface of the apparatus takes, from the ejection tray 101*a*, the printed sheet P using the right hand with its back faced upward, and the user brings the printed sheet P in front of the user, the front surface of the printed sheet P faces the user, and the orientation of the printed image on the printed sheet P is the correct orientation for the user. In other words, the user can visually recognize the printed image on the front surface of the printed sheet P in the correct orientation without changing the position of the printed sheet P in the hand.

When the printed sheet P is ejected to the ejection tray 101*b* (when the sheet ejection mode is the face-up mode), the front surface of the front and back surfaces of the printed sheet P is faced upward, and the orientation of the printed image on the printed sheet P is faced rightward when seen from the front surface side of the apparatus. In this case, when the user who faces the front surface of the apparatus takes, from the ejection tray 101*b*, the printed sheet P using the right hand with its palm faced upward, and the user brings the printed sheet P in front of the user, the front surface of the printed sheet P faces the user, and the orientation of the printed image on the printed sheet P is the correct orientation for the user. In other words, the user can visually recognize the printed image on the front surface of the printed sheet P in the correct orientation without changing the position of the printed sheet P in the hand.

Hence, in the present embodiment, in order to enhance the convenience of the user, ejected-sheet information that is information for notifying the orientation of the printed sheet P ejected to the ejection tray 101 is displayed on the operation panel 8 (the liquid crystal display panel 82 of the operation display portion 81). The ejected-sheet information is information for notifying the orientation of the front and back surfaces of the printed sheet P ejected to the ejection tray 101 and the orientation of the printed image on the printed sheet P ejected to the ejection tray 101. In this configuration, the operation panel 8 corresponds to a "display position".

The ejected-sheet information described above is displayed on the operation panel 8, and thus the user can recognize the orientation of the front and back surfaces of the printed sheet P ejected to the ejection tray 101 and the orientation of the printed image on the printed sheet P without remembering the specification (the orientation of the printed sheet P ejected to the ejection tray 101) of the multifunctional machine 100. In this way, when the user brings the printed sheet P taken from the ejection tray 101 in front of the user without changing the position of the printed sheet P, the user can take the printed sheet P from the ejection tray 101 such that the front surface of the printed sheet P faces the user and that the orientation of the printed image on the printed sheet P is the correct position. In other words, the convenience of the user is enhanced.

For example, it is assumed that the sheet P with both sides printed is ejected to the ejection tray 101*a* (face-down mode). In this case, the operation panel 8 displays a printing condition screen PS on which a preview image PP as shown in FIG.

4 is provided as the ejected-sheet information. Specifically, the operation panel 8 provides, on the printing condition screen PS, the preview image PP (PP2) corresponding to the printed image on the back surface, of the front and back surfaces of the printed sheet P, that is faced upward when the printed sheet P is ejected to the ejection tray 101*a*. Furthermore, the operation panel 8 makes the orientation of the printed image on the printed sheet P ejected to the ejection tray 101*a* coincide with the orientation of the preview image PP (PP2). In other words, since in the face-down mode where the printed sheet P is ejected to the ejection tray 101*a*, the orientation of the printed image on the printed sheet P ejected to the ejection tray 101*a* is faced leftward when seen from the front surface side of the apparatus, the orientation of the preview image PP (PP2) is also faced leftward when seen from the front surface side of the apparatus.

Figure 5:
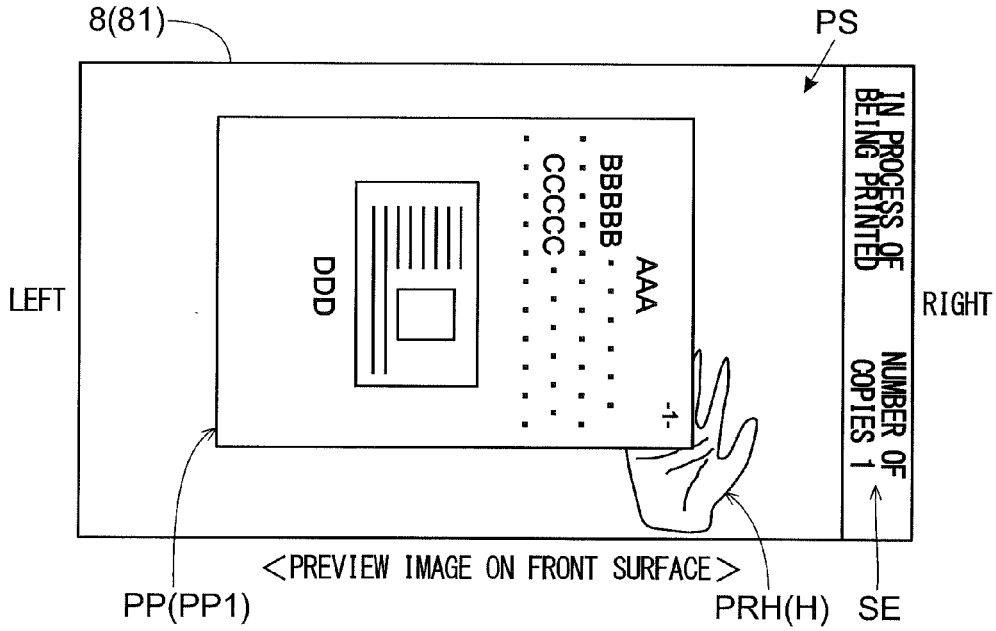
FIG. 5 A diagram showing an example of the ejected-sheet information and the how-to-take-the-sheet information displayed on the operation panel of the multifunctional machine according to the embodiment of the present disclosure (diagram when the printed sheet is ejected such that the front surface of the printed sheet is faced upward and the printed image is faced rightward)

Moreover, it is assumed that the sheet P with both sides printed is ejected to the ejection tray 101*b* (face-up mode). In this case, the operation panel 8 displays a printing condition screen PS on which a preview image PP as shown in FIG. 5 is provided as the ejected-sheet information. Specifically, the operation panel 8 provides, on the printing condition screen PS, the preview image PP (PP1) corresponding to the printed image on the front surface, of the front and back surfaces of the printed sheet P, that is faced upward when the printed sheet P is ejected to the ejection tray 101*b*. Furthermore, the operation panel 8 makes the orientation of the printed image on the printed sheet P ejected to the ejection tray 101*b* coincide with the orientation of the preview image PP (PP1). In other words, since in the face-up mode where the printed sheet P is ejected to the ejection tray 101*b*, the orientation of the printed image on the printed sheet P ejected to the ejection tray 101*b* is faced rightward when seen from the front surface side of the apparatus, the orientation of the preview image PP (PP1) is also faced rightward when seen from the front surface side of the apparatus.

In this way, for the user who faces the front surface of the apparatus, the preview image PP displayed on the operation panel 8 indicates the orientation of the front and back surfaces of the printed sheet P ejected to the ejection tray 101 and the orientation of the printed image on the printed sheet P. Thus, it is possible to easily make the user recognize the orientation of the front and back surfaces of the printed sheet P ejected to the ejection tray 101 and the orientation of the printed image on the printed sheet P.

In the configuration in which the orientation of the printed image on the printed sheet P ejected to the ejection tray 101 can be arbitrarily set, in the face-down mode where the printed sheet P is ejected to the ejection tray 101*a*, the orientation of the printed image on the printed sheet P may be faced rightward when seen from the front surface side of the apparatus, and in the face-up mode where the printed sheet P is ejected to the ejection tray 101*b*, the orientation of the printed image on the printed sheet P may be faced leftward when seen from the front surface side of the apparatus. Even in such a case, the operation panel 8 makes the orientation of the printed image on the printed sheet P ejected to the ejection tray 101 coincide with the orientation of the preview image PP.

Figure 6:
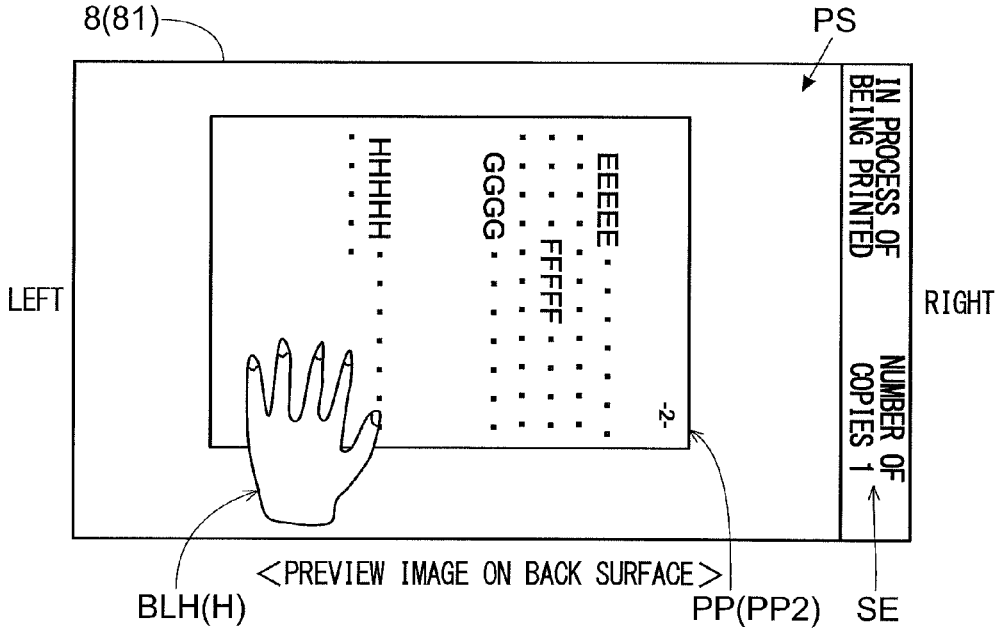
FIG. 6 A diagram showing an example of the ejected-sheet information and the how-to-take-the-sheet information displayed on the operation panel of the multifunctional machine according to the embodiment of the present disclosure (diagram when the printed sheet is ejected such that the front surface of the printed sheet is faced downward and the printed image is faced rightward)
Figure 7:
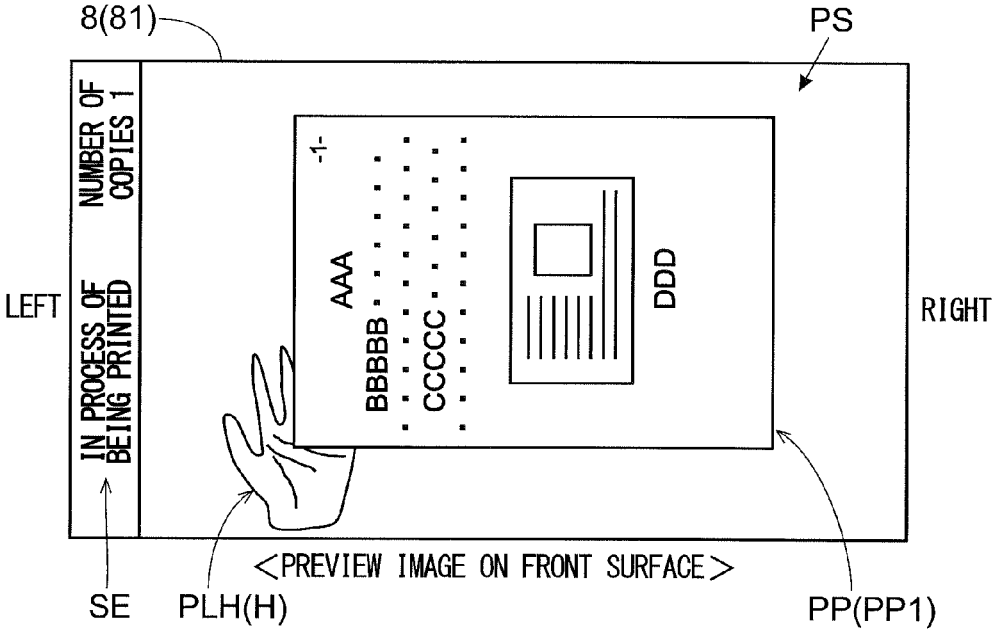
FIG. 7 A diagram showing an example of the ejected-sheet information and the how-to-take-the-sheet information displayed on the operation panel of the multifunctional machine according to the embodiment of the present disclosure (diagram when the printed sheet is ejected such that the front surface of the printed sheet is faced upward and the printed image is faced leftward)

In other words, when in the face-down mode where the printed sheet P is ejected to the ejection tray 101*a*, the orientation of the printed image on the printed sheet P ejected to the ejection tray 101*a* is faced rightward when seen from the front surface side of the apparatus, as shown in FIG. 6, the operation panel 8 provides, on the printing condition screen PS, the preview image PP2 corresponding to the printed image on the back surface of the printed sheet P, and makes the orientation of the preview image PP2 faced rightward when seen from the front surface side of the apparatus. On the other hand, when in the face-up mode where the printed sheet P is ejected to the ejection tray 101*b*, the orientation of the printed image on the printed sheet P ejected to the ejection tray 101*b* is faced leftward when seen from the front surface side of the apparatus, as shown in FIG. 7, the operation panel 8 provides, on the printing condition screen PS, the preview image PP1 corresponding to the printed image on the front surface of the printed sheet P, and makes the orientation of the preview image PP1 faced leftward when seen from the front surface side of the apparatus.

Figure 4:
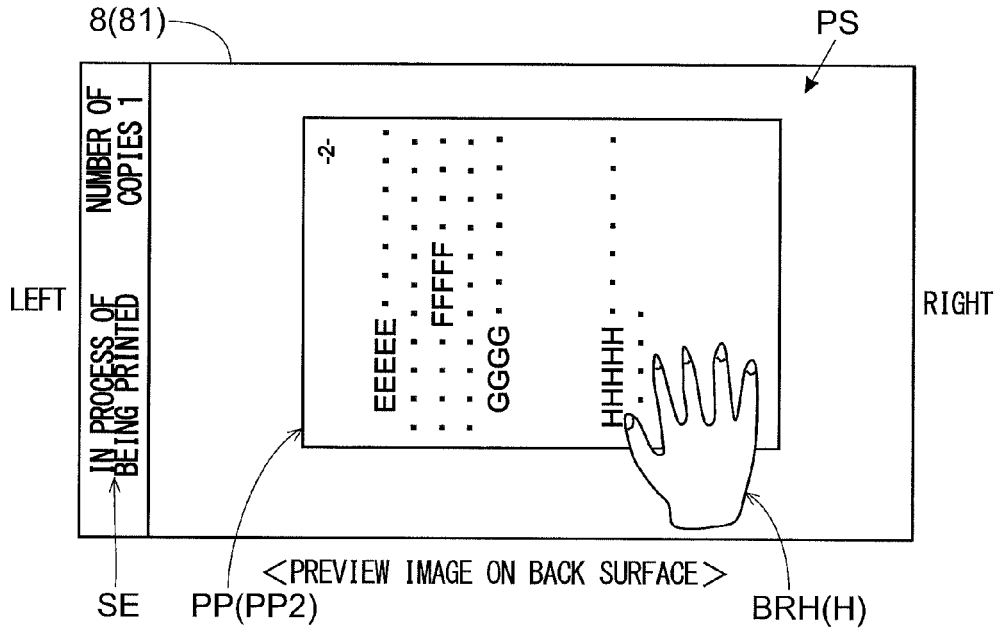
FIG. 4 A diagram showing an example of ejected-sheet information and how-to-take-the-sheet information displayed on an operation panel of the multifunctional machine according to the embodiment of the present disclosure (diagram when a printed sheet is ejected such that the front surface of the printed sheet is faced downward and a printed image is faced leftward)
Figure 8:
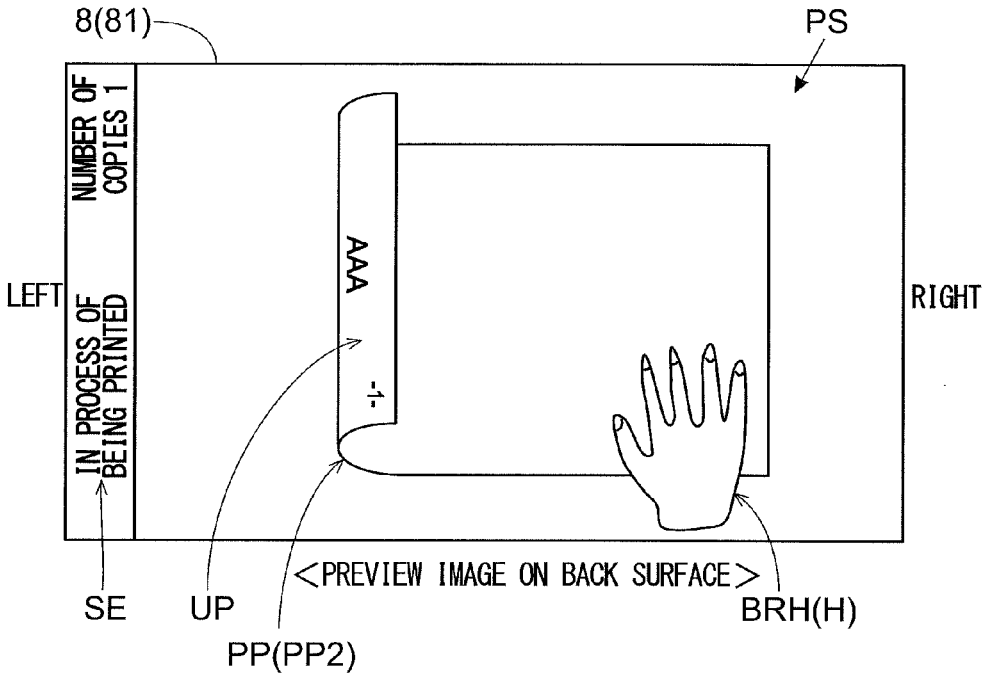
FIG. 8 A diagram showing an example of the ejected-sheet information and the how-to-take-the-sheet information displayed on the operation panel of the multifunctional machine according to the embodiment of the present disclosure (diagram when an image in which an upper side part of the printed sheet is folded back is produced as a preview image)

Incidentally, since in the face-down mode where the printed sheet P is ejected to the ejection tray 101*a*, the front surface of the front and back surfaces of the printed sheet P is faced downward and the back surface is faced upward, the preview image PP provided on the printing condition screen PS corresponds to the printed image on the back surface of the printed sheet P (see FIGS. 4 and 6). In this case, when the printed sheet P in which the image is printed on only the front surface of the front and back surfaces is ejected to the ejection tray 101*a*, since there is no printed image on the back surface of the printed sheet P, the preview image PP is a white image. When the preview image PP is the white image as described above, though it is possible to determine, from the preview image PP, the orientation of the front and back surfaces of the printed sheet P, it is impossible to determine the orientation of the printed image on the printed sheet P only with the preview image PP. Hence, an image as shown in FIG. 8 may be used as the preview image PP.

Specifically, the operation panel 8 produces, as the preview image PP, an image in which an upper side part (which corresponds to a "predetermined part") of the printed sheet P is folded back. Then, the operation panel 8 displays a part of the printed image on the front surface, of the front and back surfaces of the printed sheet P, that is faced downward when the printed sheet P is ejected to the ejection tray 101*a*, on a part UP (part which corresponds to the upper side part of the printed sheet P) of the preview image PP. In this way, even when the back surface of the printed sheet P is white (even when the preview image PP is the white image), since the part of the printed image on the front surface of the printed sheet P is displayed on the part UP of the preview image PP, it is possible to identify the orientation of the printed image of the printed sheet P. The part UP of the preview image PP indicates the part of the printed sheet P that is folded back. Hence, the orientation of the image on the part UP of the preview image PP does not coincide with the orientation of the printed image on the printed sheet P ejected to the ejection tray 101*a*.

In order for the orientation of the printed image on the printed sheet P ejected to the ejection tray 101 to be more easily found, as shown in FIGS. 4 to 7, the orientation of a predetermined screen sheet SE (for example, all screen elements SE) among the screen elements SE of the printing condition screen PS other than the preview image PP may also be made to coincide with the orientation of the printed image on the printed sheet P ejected to the ejection tray 101. For example, on the printing condition screen PS, in addition to the preview image PP, a plurality of text messages such as "in the process of printing" and "the number of copies" are provided as the screen elements SE. As described above, the orientation of all the screen elements SE (including the preview image PP) of the printing condition screen SS is made to coincide with the orientation of the printed image on the printed sheet P ejected to the ejection tray 101, and thus the orientation of the printed image on the printed sheet P is more easily identified.

Figure 9:
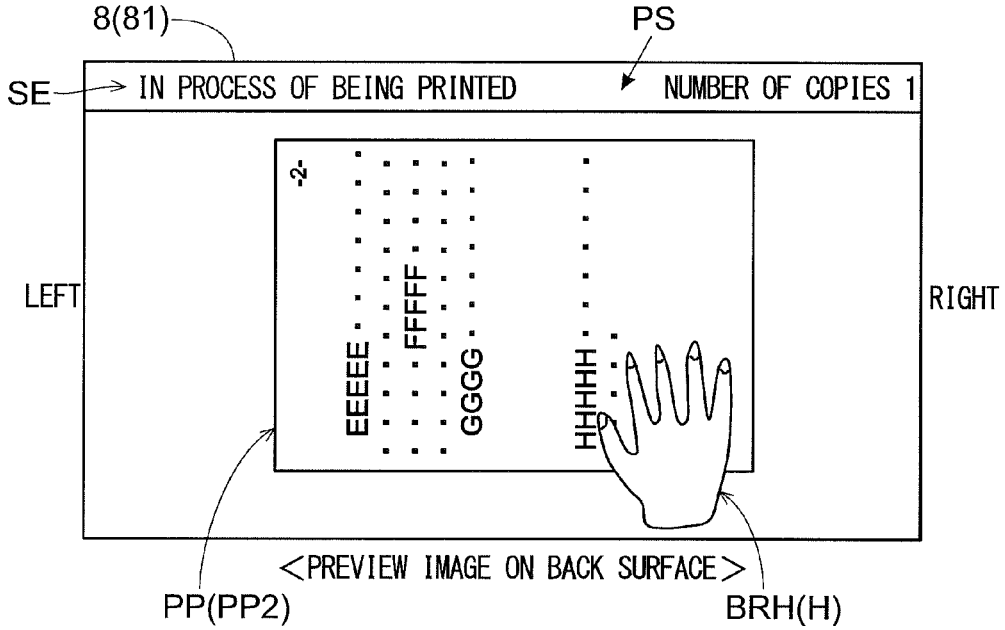
FIG. 9 A diagram showing an example of the ejected-sheet information and the how-to-take-the-sheet information displayed on the operation panel of the multifunctional machine according to the embodiment of the present disclosure (diagram when only the orientation of the preview image among screen elements is made to coincide with the orientation of the printed image on the printed sheet)

However, as shown in FIG. 9, only the orientation of the preview image PP may be made to coincide with the orientation of the printed image on the printed sheet P ejected to the ejection tray 101, and the orientation of the screen elements SE other than the preview image PP may be the correct orientation for the user who faces the front surface of the apparatus.

Figure 10:
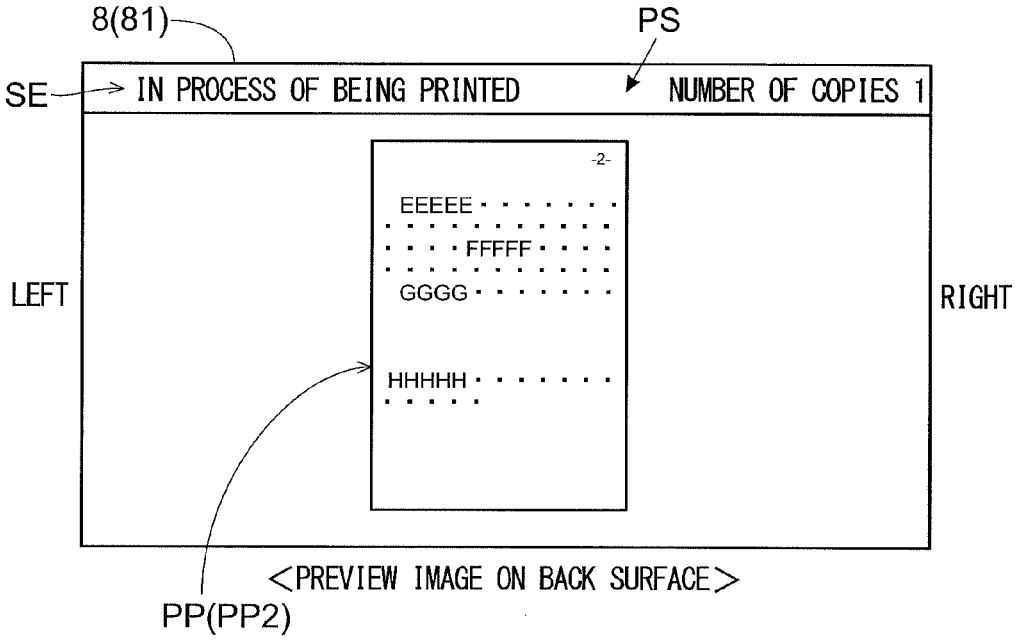
FIG. 10 A diagram showing an example of the ejected-sheet information and the how-to-take-the-sheet information displayed on the operation panel of the multifunctional machine according to the embodiment of the present disclosure (diagram before the orientation of the preview image is made to coincide with the orientation of the printed image on the printed sheet)

A configuration may also be adopted in which as shown in FIG. 10, first, the printing condition screen PS is displayed such that the orientation of the printing condition screen PS is the correct orientation for the user who faces the front surface of the apparatus, and thereafter as shown in FIG. 4 or 6, the printing condition screen PS is rotated such that the orientation of the printing condition screen PS is made to coincide with the orientation of the printed image on the printed sheet P ejected to the ejection tray 101. Here, an animation display in which the orientation of the printing condition screen PS is gradually changed may be produced.

Figure 11:
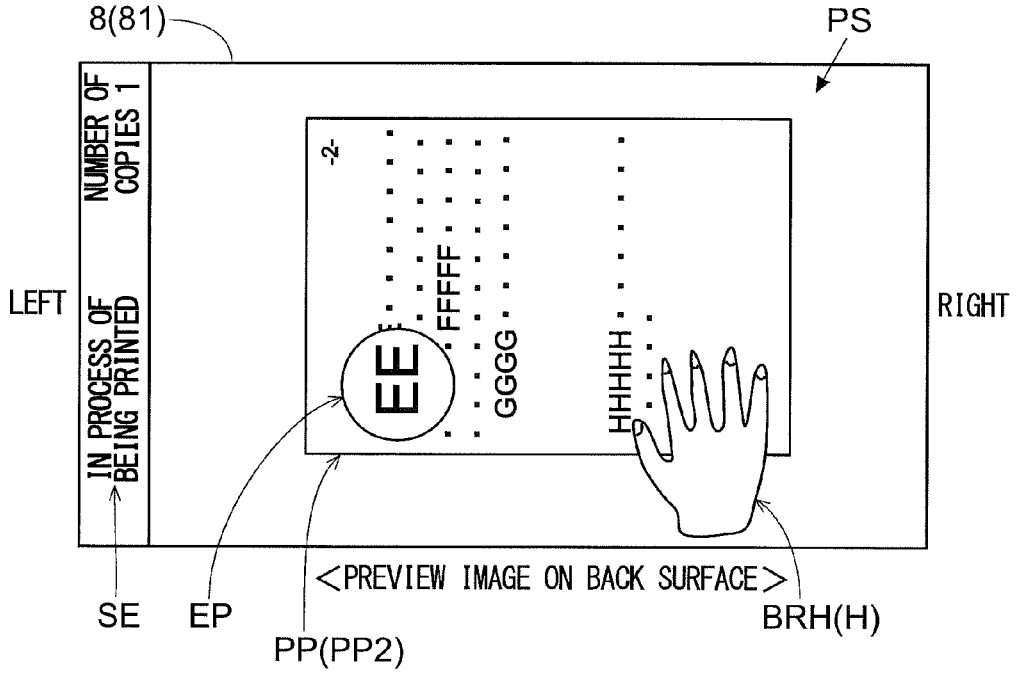
FIG. 11 A diagram showing an example of the ejected-sheet information and the how-to-take-the-sheet information displayed on the operation panel of the multifunctional machine according to the embodiment of the present disclosure (diagram when a part of the preview image is enlarged and displayed)

As shown in FIG. 11, when the preview image PP is displayed, a part EP of the preview image PP may be enlarged with respect to the other parts. For example, symbols such as characters or numbers on the part EP of the preview image PP are enlarged to about 16 dots (about the size that can be determined by the user). In this way, even when the display size of the preview image PP is small in whole, since the part EP of the preview image PP is enlarged and displayed, it is possible to reduce difficulty in identifying the orientation of the printed image on the printed sheet P. An enlargement factor of the part EP of the preview image PP can be changed according to the screen size or the like; the enlargement factor may be increased or decreased.

Furthermore, in the present embodiment, in order for the convenience of the user to be enhanced, when the ejected-sheet information is displayed, how-to-take-the-sheet information that is information for notifying how to take the printed sheet P from the ejection tray 101 is displayed on the operation panel 8 (the liquid crystal display panel 82 of the operation display portion 81). The how-to-take-the-sheet information is information for notifying how to take the printed sheet P from the ejection tray 101 such that when the user takes the printed sheet P ejected to the ejection tray 101 and brings it in front of the user, the front surface of the front and back surfaces of the printed sheet P faces the user, and the orientation of the printed image on the printed sheet P is the correct orientation for the user.

Specifically, in a case where the front surface of the printed sheet P is faced downward, and the orientation of the printed image on the printed sheet P is faced leftward when seen from the front surface side of the apparatus (see FIG. 4), when the user who faces the front surface of the apparatus takes the printed sheet P using the right hand with its back faced upward, and brings the printed sheet P in front of the user, the front surface of the printed sheet P faces the user, and the orientation of the printed image on the printed sheet P is the correct orientation for the user.

In a case where the front surface of the printed sheet P is faced upward, and the orientation of the printed image on the printed sheet P is faced rightward when seen from the front surface side of the apparatus (see FIG. 5), when the user who faces the front surface of the apparatus takes the printed sheet P using the right hand with its palm faced upward, and brings the printed sheet P in front of the user, the front surface of the printed sheet P faces the user, and the orientation of the printed image on the printed sheet P is the correct orientation for the user.

In a case where the front surface of the printed sheet P is faced downward, and the orientation of the printed image on the printed sheet P is faced rightward when seen from the front surface side of the apparatus (see FIG. 6), when the user who faces the front surface of the apparatus takes the printed sheet P using the left hand with its back faced upward, and brings the printed sheet P in front of the user, the front surface of the printed sheet P faces the user, and the orientation of the printed image on the printed sheet P is the correct orientation for the user.

In a case where the front surface of the printed sheet P is faced upward, and the orientation of the printed image on the printed sheet P is faced leftward when seen from the front surface side of the apparatus (see FIG. 7), when the user who faces the front surface of the apparatus takes the printed sheet P using the left hand with its palm faced upward, and brings the printed sheet P in front of the user, the front surface of the printed sheet P faces the user, and the orientation of the printed image on the printed sheet P is the correct orientation for the user.

Hence, the operation panel 8 displays, as the how-to-take-the-sheet information, the hand image H of any one of a right hand image BRH (see FIG. 4) with its back faced upward, a right hand image PRH (see FIG. 5) with its palm faced upward, a left hand image BLH (see FIG. 6) with its back faced upward and a left hand image PLH (see FIG. 7) with its palm faced upward, and thereby notifies the optimum method of taking the printed sheet P from the ejection tray 101. However, the form of the display of the how-to-take-the-sheet information is not particularly limited, and a text message may be displayed as the how-to-take-the-sheet information or the hand image H and the text message may be combined.

When the front surface of the printed sheet P is faced downward, and the orientation of the printed image on the printed sheet P is faced leftward when seen from the front surface side of the apparatus, as shown in FIG. 4, the operation panel 8 displays the right hand image BRH with its back faced upward as the how-to-take-the-sheet information, and thereby provides a notification such that the user takes the printed sheet P using the right hand with its back faced upward. When the front surface of the printed sheet P is faced upward, and the orientation of the printed image on the printed sheet P is faced rightward when seen from the front surface side of the apparatus, as shown in FIG. 5, the operation panel 8 displays the right hand image PRH with its palm faced upward as the how-to-take-the-sheet information, and thereby provides a notification such that the user takes the printed sheet P using the right hand with its palm faced upward. When the front surface of the printed sheet P is faced downward, and the orientation of the printed image on the printed sheet P is faced rightward when seen from the front surface side of the apparatus, as shown in FIG. 6, the operation panel 8 displays the left hand image BLH with its back faced upward as the how-to-take-the-sheet information, and thereby provides a notification such that the user takes the printed sheet P using the left hand with its back faced upward. When the front surface of the printed sheet P is faced upward, and the orientation of the printed image on the printed sheet P is faced leftward when seen from the front surface side of the apparatus, as shown in FIG. 7, the operation panel 8 displays the left hand image PLH with its palm faced upward, and thereby provides a notification such that the user takes the printed sheet P using the left hand with its palm faced upward.

As described above, the how-to-take-the-sheet information (the hand image H) is displayed to notify how to take the printed sheet P from the ejection tray 101, and thus it is easy to find which one of the right hand and the left hand should be used to take the printed sheet P and which one of the back and the palm should be faced upward to take the printed sheet P.

When the hand image H is displayed, the operation panel 8 displays the hand image H such that the hand image H is overlaid on the preview image PP. For example, when in order for the optimum method of taking the printed sheet P from the ejection tray 101 to be notified more clearly, the right hand image BRH (see FIG. 4) with its back faced upward and the left hand image BLH (see FIG. 6) with its back faced upward are displayed, the hand image H is displayed in a higher layer than the preview image PP (a superimposition portion of the preview image PP on which the hand image H is superimposed is not displayed). When the right hand image PRH (see FIG. 5) with its palm faced upward and the left hand image PLH (see FIG. 7) with its palm faced upward are displayed, the hand image H is displayed in a lower layer than the preview image PP (a superimposition portion of the hand image H on which the preview image PP is superimposed is not displayed).

(Reception of an Input for Setting Whether the Printed Sheet is Taken by the Right Hand or the Left Hand)

Figure 12:
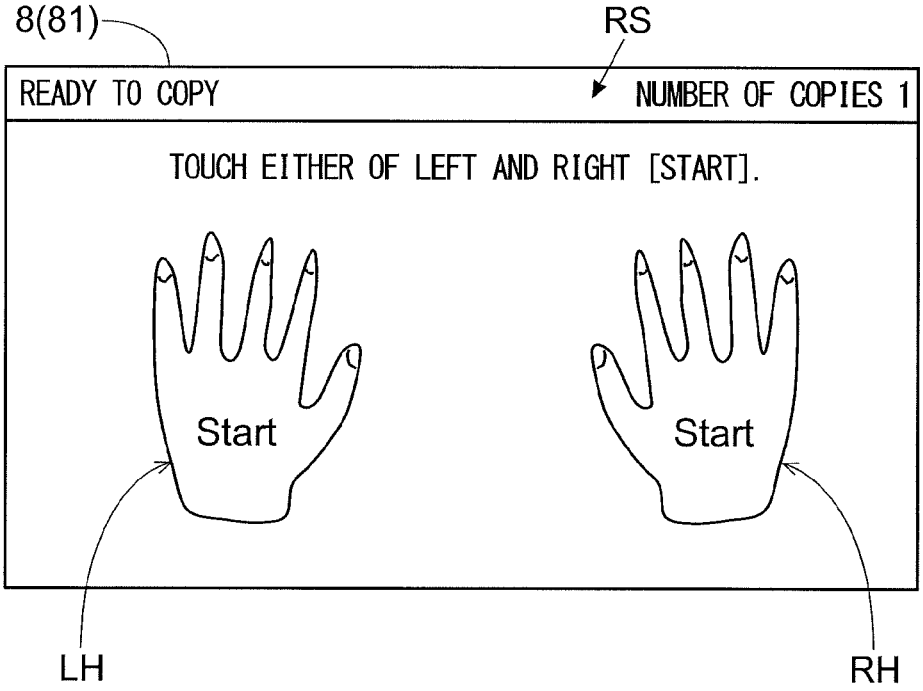
FIG. 12 A diagram showing an example of a reception screen (screen for receiving an instruction to perform a job) displayed on the operation panel of the multifunctional machine according to the embodiment of the present disclosure.

When the operation panel 8 receives an instruction to start a job (copying job) involving printing, the operation panel 8 displays a reception screen RS as shown in FIG. 12. On the reception screen RS, a right hand image RH and a left hand image LH are provided. When on the reception screen RS, the display region of any one of the right hand image RH and the left hand image LH is touched, the operation panel 8 receives the touch operation as an instruction to start the copying job. Then, the main control portion 110 instructs the printing portion 2 to perform the copying job.

Here, in a case where the right hand image RH is touched, the main control portion 110 makes the printing portion 2 perform printing and makes the printed sheet P ejected to the ejection tray 101*a* such that the front surface of the printed sheet P is faced downward and that the printed image on the printed sheet P is faced leftward when seen from the front surface side of the apparatus. The main control portion 110 displays, on the operation panel 8, the printing condition screen PS shown in FIG. 4.

However, even in a case where the right hand image RH is touched, when the sheet ejection mode is set at the face-up mode, the main control portion 110 makes the printing portion 2 perform printing and makes the printed sheet P ejected to the ejection tray 101*b* such that the front surface of the printed sheet P is faced upward and that the printed image on the printed sheet P is faced rightward when seen from the front surface side of the apparatus. Then, the main control portion 110 displays, on the operation panel 8, the printing condition screen PS shown in FIG. 5. The sheet ejection mode may be switched from the face-up mode to the face-down mode, and thus the printed sheet P may be ejected to the ejection tray 101*a* such that the front surface of the printed sheet P is faced downward and that the printed image on the printed sheet P is faced leftward when seen from the front surface side of the apparatus (the printing condition screen PS shown in FIG. 4 is displayed by the operation panel 8).

On the other hand, in a case where the left hand image LH is touched, the main control portion 110 makes the printing portion 2 perform printing and makes the printed sheet P ejected to the ejection tray 101*a* such that the front surface of the printed sheet P is faced downward and that the printed image on the printed sheet P is faced rightward when seen from the front surface side of the apparatus. The main control portion 110 displays, on the operation panel 8, the printing condition screen PS shown in FIG. 6.

However, even in a case where the left hand image LH is touched, when the sheet ejection mode is set at the face-up mode, the main control portion 110 makes the printing portion 2 perform printing and makes the printed sheet P ejected to the ejection tray 101*b* such that the front surface of the printed sheet P is faced upward and that the printed image on the printed sheet P is faced leftward when seen from the front surface side of the apparatus. Then, the main control portion 110 displays, on the operation panel 8, the printing condition screen PS shown in FIG. 7. The sheet ejection mode may be switched from the face-up mode to the face-down mode, and thus the printed sheet P may be ejected to the ejection tray 101*a* such that the front surface of the printed sheet P is faced downward and that the printed image on the printed sheet P is faced rightward when seen from the front surface side of the apparatus (the printing condition screen PS shown in FIG. 6 is displayed by the operation panel 8).

In this way, in the copying job started by the reception of the touch of the right hand image RH on the reception screen RS, when the user takes the printed sheet P ejected to the 101 using the right hand, and brings the printed sheet P in front of the user, the front surface of the printed sheet P faces the user, and the orientation of the printed image on the printed sheet P is the correct orientation for the user. On the other hand, in the copying job started by the reception of the touch of the left hand image LH on the reception screen RS, when the user takes the printed sheet P ejected to the 101 using the left hand, and brings the printed sheet P in front of the user, the front surface of the printed sheet P faces the user, and the orientation of the printed image on the printed sheet P is the correct orientation for the user. In other words, the reception screen RS is the screen for receiving the instruction to start the copying job, and is simultaneously the screen for receiving the input for setting whether the printed sheet P ejected to the ejection tray 101 is taken by the right hand or the left hand. In this configuration, the operation panel 8 that displays the reception screen RS corresponds to an "input portion".

In the configuration where the reception screen RS described above is displayed, when the printed sheet P is desired to be taken by the right hand, an input for making a setting such that the printed sheet P is taken by the right hand is performed on the operation panel 8, and thus the orientation of the printed sheet P ejected to the ejection tray 101 can be made suitable for the case where it is taken by the right hand. On the other hand, when the printed sheet P is desired to be taken by the left hand, an input for making a setting such that the printed sheet P is taken by the left hand is performed on the operation panel 8, and thus the orientation of the printed sheet P ejected to the ejection tray 101 can be made suitable for the case where it is taken by the left hand. Hence, the convenience of the user is enhanced. In particular, the convenience of the user with one hand impaired is enhanced.

Not only the copying job but also the printing job is a job that involves printing. In the printing job, job data (data including image data and the like) transmitted from the computer 200 is received by the communication portion 130, and based on the job data received by the communication portion 130, printing is performed by the printing portion 2. In this case, whether the printed sheet P ejected to the ejection tray 101 is taken by the right hand or the left hand is set on the computer 200. Then, when the job data is transmitted from the computer 200, data (reception hand data) indicating whether the printed sheet P ejected to the ejection tray 101 is taken by the right hand or the left hand is also transmitted, and is received by the communication portion 130. Then, based on the reception hand data received by the communication portion 130, the main control portion 110 sets the orientation of the front and back surfaces of the printed sheet P ejected to the ejection tray 101 and the orientation of the printed image.

(Flow of Control when the Job Involving Printing is Performed)

Figure 13:
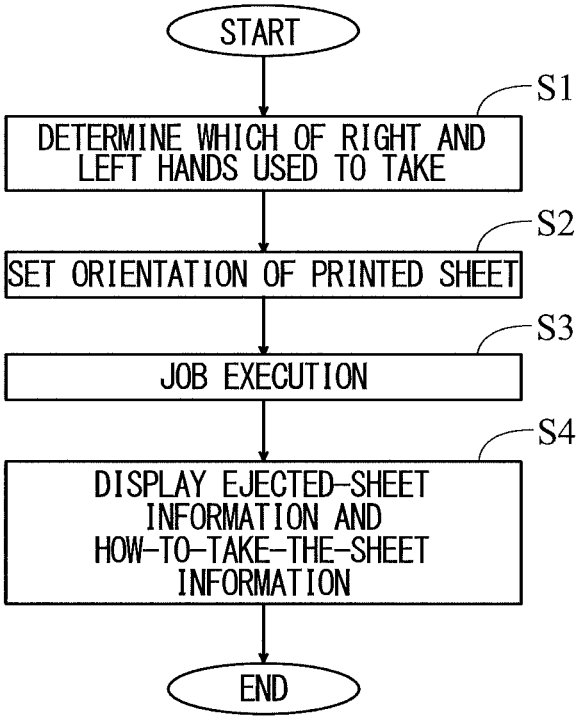
FIG. 13 A flowchart for illustrating the flow of control when a job is performed in the multifunctional machine according to the embodiment of the present disclosure.

The flow of control when the job involving printing is performed will be described below with reference to a flowchart shown in FIG. 13. The start of the flowchart shown in FIG. 13 is when the operation of touching the display region of any one of the right hand image RH and the left hand image LH on the reception screen RS (see FIG. 12) is received by the operation panel 8 or when the job data (including the reception hand data) is received by the communication portion 130.

In step S1, the main control portion 110 determines whether an input for making a setting such that the printed sheet P ejected to the ejection tray 101 is taken by the right hand is received or an input for making a setting such that the printed sheet P is taken by the left hand (determines which of the left and right hands is used to take it). Specifically, the main control portion 110 detects which one of the display regions of the right hand image RH and the left hand image LH on the reception screen RS (see FIG. 12) is touched, and when the right hand image RH is touched, the main control portion 110 determines that the input for making a setting such that the printed sheet P is taken by the right hand is received whereas when the left hand image LH is touched, the main control portion 110 determines that the input for making a setting such that the printed sheet P is taken by the left hand is received. Alternatively, when the communication portion 130 receives the job data (including the reception hand data), the main control portion 110 determines, based on the reception hand data, whether the input for making a setting such that the printed sheet P is taken by the right hand is received or the input for making a setting such that the printed sheet P is taken by the left hand is received.

Then, in step S2, the main control portion 110 sets the orientation of the front and back surfaces of the printed sheet P ejected to the ejection tray 101 and the orientation of the printed image on the printed sheet P. For example, when the input for making a setting such that the printed sheet P is taken by the right hand is received, the setting is made such that the front surface of the printed sheet P is faced downward (the setting is made such that the printed sheet P is ejected to the ejection tray 101*a*), and the setting is made such that the orientation of the printed image on the printed sheet P is faced leftward when seen from the front surface side of the apparatus. Alternatively, the setting is made such that the front surface of the printed sheet P is faced upward (the setting is made such that the printed sheet P is ejected to the ejection tray 101*b*), and the setting is made such that the orientation of the printed image on the printed sheet P is faced rightward when seen from the front surface side of the apparatus.

On the other hand, when the input for making a setting such that the printed sheet P is taken by the left hand is received, the setting is made such that the front surface of the printed sheet P is faced downward (the setting is made such that the printed sheet P is ejected to the ejection tray 101*a*), and the setting is made such that the orientation of the printed image on the printed sheet P is faced rightward when seen from the front surface side of the apparatus. Alternatively, the setting is made such that the front surface of the printed sheet P is faced upward (the setting is made such that the printed sheet P is ejected to the ejection tray 101*b*), and the setting is made such that the orientation of the printed image on the printed sheet P is faced leftward when seen from the front surface side of the apparatus.

Then, in step S3, the main control portion 110 makes the printing portion 2 perform the job. In step S4, the main control portion 110 displays the printing condition screen PS (the ejected-sheet information and the how-to-take-the-sheet information) on the operation panel 8. Specifically, when the front surface of the printed sheet P is faced downward, and the orientation of the printed image on the printed sheet P is faced leftward when seen from the front surface side of the apparatus, the printing condition screen PS as shown in FIG. 4 is displayed. When the front surface of the printed sheet P is faced upward, and the orientation of the printed image on the printed sheet P is faced rightward when seen from the front surface side of the apparatus, the printing condition screen PS as shown in FIG. 5 is displayed. When the front surface of the printed sheet P is faced downward, and the orientation of the printed image on the printed sheet P is faced rightward when seen from the front surface side of the apparatus, the printing condition screen PS as shown in FIG. 6 is displayed. When the front surface of the printed sheet P is faced upward, and the orientation of the printed image on the printed sheet P is faced leftward when seen from the front surface side of the apparatus, the printing condition screen PS as shown in FIG. 7 is displayed.

It should be considered that the embodiment disclosed herein is illustrative in all respects, and not restrictive. The scope of the present disclosure is indicated not by the description of the above embodiment but by the scope of claims, and further includes the meanings equivalent to the scope of claims and all modifications within the scope.

What is claimed is:

1. An image forming apparatus comprising:

an ejection tray;

a printing portion that prints, on a sheet, an image based on image data and that ejects the printed sheet to the ejection tray; and a display portion that displays ejected-sheet information for notifying an orientation of front and back surfaces of the printed sheet ejected to the ejection tray and an orientation of the printed image on the printed sheet;

wherein when the display portion displays the ejected-sheet information, the display portion displays how-to-take-the-sheet information for notifying how to take the printed sheet from the ejection tray, and the how-to-take-the-sheet information is information for notifying how to take the printed sheet from the ejection tray such that when a user takes the printed sheet from the ejection tray and brings the printed sheet in front of the user, the front surface of the front and back surfaces of the printed sheet faces the user and that the orientation of the printed image on the printed sheet is a correct orientation for the user.

2. The image forming apparatus of claim 1, wherein when the front surface of the printed sheet ejected to the ejection tray is faced downward, and the orientation of the printed image on the printed sheet is faced leftward when seen from a front surface side of the apparatus, the display portion displays, as the how-to -take-the-sheet information, information for notifying an instruction to take the printed sheet using a right hand with a back faced upward, when the front surface of the printed sheet ejected to the ejection tray is faced upward, and the orientation of the printed image on the printed sheet is faced rightward when seen from the front surface side of the apparatus, the display portion displays, as the how-to -take-the-sheet information, information for notifying an instruction to take the printed sheet using the right hand with a palm faced upward, when the front surface of the printed sheet ejected to the ejection tray is faced downward, and the orientation of the printed image on the printed sheet is faced rightward when seen from the front surface side of the apparatus, the display portion displays, as the how-to -take-the-sheet information, information for notifying an instruction to take the printed sheet using a left hand with a back faced upward and when the front surface of the printed sheet ejected to the ejection tray is faced upward, and the orientation of the printed image on the printed sheet is faced leftward when seen from the front surface side of the apparatus, the display portion displays, as the how-to -take-the-sheet information, information for notifying an instruction to take the printed sheet using the left hand with a palm faced upward.

3. The image forming apparatus of claim 2, wherein when the instruction to take the printed sheet using the right hand with the back faced upward is notified, the display portion displays, as the how-to-take-the-sheet information, an image indicating the right hand with the back faced upward, when the instruction to take the printed sheet using the right hand with the palm faced upward is notified, the display portion displays, as the how-to-take-the-sheet information, an image indicating the right hand with the palm faced upward, when the instruction to take the printed sheet using the left hand with the back faced upward is notified, the display portion displays, as the how-to-take-the-sheet information, an image indicating the left hand with the back faced upward and when the instruction to take the printed sheet using the left hand with the palm faced upward is notified, the display portion displays, as the how-to-take-the-sheet information, an image indicating the left hand with the palm faced upward.

4. The image forming apparatus of claim 3, wherein when the display portion displays the ejected-sheet information, the display portion displays, as the ejected-sheet information, a preview image corresponding to the printed image on the printed sheet such that the how-to-take-the-sheet information is overlaid on the preview image, and when the display portion displays, as the how-to-take-the-sheet information, the image indicating the hand with the back faced upward, the display portion displays the image indicating the hand with the back faced upward in a higher layer than the preview image whereas when the display portion displays, as the how-to-take-the-sheet information, the image indicating the hand with the palm faced upward, the display portion displays the image indicating the hand with the palm faced upward in a lower layer than the preview image.

5. An image forming apparatus comprising:

an election tray;

a printing portion that prints, on image forming apparatus a sheet, an image based on image data and that ejects the printed sheet to the election tray; and a display portion that displays ejected-sheet information for notifying an orientation of front and back surfaces of the printed sheet ejected to the ejection tray and an orientation of the printed image on the printed sheet;

an input portion that receives an input for setting whether the printed sheet ejected to the ejection tray is taken by the right hand or the left hand, wherein when the input portion receives an input for making a setting such that the printed sheet is taken by the right hand, the printing portion prints the image on the sheet and ejects the printed sheet to the ejection tray either such that the front surface of the front and back surfaces of the printed sheet is faced downward and the orientation of the printed image on the printed sheet is faced leftward when seen from the front surface side of the apparatus or such that the front surface of the front and back surfaces of the printed sheet is faced upward and the orientation of the printed image on the printed sheet is faced rightward when seen from the front surface side of the apparatus and when the input portion receives an input for making a setting such that the printed sheet is taken by the left hand, the printing portion prints the image on the sheet and ejects the printed sheet to the ejection tray either such that the front surface of the front and back surfaces of the printed sheet is faced downward and the orientation of the printed image on the printed sheet is faced rightward when seen from the front surface side of the apparatus or such that the front surface of the front and back surfaces of the printed sheet is faced upward and the orientation of the printed image on the printed sheet is faced leftward when seen from the front surface side of the apparatus.

6. The image forming apparatus of claim 5, wherein the input portion is a touch panel provided in the display portion, when the touch panel receives the input for setting whether the printed sheet is taken by the right hand or the left hand, the display portion displays a right hand image and a left hand image and the touch panel receives an operation of touching a display region of the right hand image as the input for making a setting such that the printed sheet is taken by the right hand, and receives an operation of touching a display region of the left hand image as the input for making a setting such that the printed sheet is taken by the left hand.

7. The image forming apparatus of claim 6, wherein the touch panel receives the operation of touching the display region of any one of the right hand image and the left hand image as an instruction to start a job involving printing.

8. An image forming apparatus comprising:

an ejection tray;

a printing portion that prints, on a sheet, an image based on image data and that ejects the printed sheet to the ejection tray; and a display portion that displays ejected-sheet information for notifying an orientation of front and back surfaces of the printed sheet ejected to the ejection tray and an orientation of the printed image on the printed sheet;

wherein the display portion displays, as the ejected-sheet information, a preview image corresponding to a printed image on a surface, of the front and back surfaces of the printed sheet, that is faced upward when the printed sheet is ejected to the ejection tray, and makes an orientation of the preview image coincide with the orientation of the printed image on the printed sheet ejected to the ejection tray; and wherein when the display portion displays the preview image, the display position enlarges the part of the preview image with respect to the other parts.

9. The image forming apparatus of claim 8, wherein the display portion produces, as the preview image, an image in which a predetermined part of the printed sheet is folded back, and displays, on a part of the preview image corresponding to the predetermined part, a part of a printed image on a surface, of the front and back surfaces of the printed sheet, that is faced downward when the printed sheet is ejected to the ejection tray.

10. The image forming apparatus of claim 8, wherein the display portion makes an orientation of a predetermined screen element among screen elements of a screen in which the preview image is provided coincide with the orientation of the printed image on the printed sheet ejected to the ejection tray.

* * * * *